US005671704A

United States Patent [19]

Peng

[11] Patent Number: 5,671,704

[45] Date of Patent: Sep. 30, 1997

[54] CYLINDER HEAD WITH COLANDER VALVE

[76] Inventor: Huei Peng, 1288 Gingerwood, Milpitas, Calif. 95035

[21] Appl. No.: 618,245

[22] Filed: Mar. 18, 1996

[51] Int. Cl.[6] ..... F01L 1/28; F01L 3/00

[52] U.S. Cl. ..... 123/79 R; 123/188.3

[58] Field of Search ..... 123/79 R, 188.3, 123/188.4, 188.2

[56] References Cited

U.S. PATENT DOCUMENTS

| | | | |
|---|---|---|---|
| 1,252,692 | 1/1918 | Harris | 123/79 R |
| 1,765,359 | 6/1930 | Adamson | 123/79 R |
| 2,416,512 | 2/1947 | Boorer | 123/79 R |
| 4,075,986 | 2/1978 | Keck | 123/79 R |
| 4,503,817 | 3/1985 | Klomp et al. | 123/79 R |
| 4,674,450 | 6/1987 | Krajancich | 123/79 A |
| 5,005,538 | 4/1991 | Bergeron | 123/79 R |
| 5,020,486 | 6/1991 | Unger | 123/79 R |
| 5,205,246 | 4/1993 | McWhorter | 123/79 R |
| 5,331,929 | 7/1994 | Plantan | 123/79 R |
| 5,398,647 | 3/1995 | Rivera | 123/79 R |

FOREIGN PATENT DOCUMENTS

| | | | |
|---|---|---|---|
| 3438847 | 4/1986 | Germany | 123/79 R |
| 52-11319 | 1/1977 | Japan | 123/79 R |

*Primary Examiner*—David A. Okonsky

[57] ABSTRACT

A cylinder head with single colander valve per cylinder for internal combustion engines (IC engine) and the like is provided. The single colander valve per cylinder has significantly enlarged valve open area and remains fully open at the end of the exhaust stroke and at the beginning of the intake stroke. The volumetric efficiency of IC engines, therefore, is significantly improved. The cylinder head with single colander valve per cylinder and support members of the present invention is practical because of the following features: single colander valve per cylinder has light weight and operates under low temperature. Some of advantages associated with these features are the following: (a) single colander valve has greater durability, (b) the compression ratio of IC engines may be raised, (c) dynamic effects on the valve train are reduced, (d) the speed of IC engines is increased, (e) the polluting emission is reduced, and (f) the fuel economy is improved. Also colander valves, which have different combinations of face-down aperture(s) and/or face-up aperture(s) disposed on the heads of the colander valves, are provided for IC engines, which have at least two valves per cylinder, and the like. Overall the present invention improves the comprehensive performance of IC engines and the like.

17 Claims, 4 Drawing Sheets

CYLINDER HEAD WITH COLANDER VALVE

BACKGROUND OF THE INVENTION (1) Field of the Invention

The present invention relates to a novel colander valve and to a novel cylinder head with a single valve per cylinder for internal combustion engines (IC engine) and the like, a single colander valve per cylinder for both the intake and exhaust functions. The present invention is a conventional cylinder head with at least two valves per cylinder, for providing a single colander valve per cylinder with lighter weight than that of a single poppet valve per cylinder proposed in prior art, and for transferring heat from the single colander valve per cylinder to the cylinder head effectively.

(2) Prior Art

Fuel efficiency requirements by the US and other governments throughout the would become increasingly more difficult to attain. Since the power of an IC engine is proportional to the mass flow rate of gases, the effective valve open area should be as large as practical for maximum performance. To obtain large valve open area, IC engine with more than two valves per cylinder have been manufactured. For a naturally aspirated IC engine, however, the volumetric efficiency is only about 50% to 80% at high speed and, thus, still needs to be improved. In order to increase the volumetric efficiency, recently the concept of single valve per cylinder has re-raised, such as the U.S. Pat. No. 4,075,986 to Keck (1978), the U.S. Pat. No. 4,674,450 to Krajancich (1987), the U.S. Pat. No. 5,020,486 to Unger (1991), the U.S. Pat. No. 5,205,246 to McWhorter (1993), the U.S. Pat. No. 5,331,929 to Plantan (1994), and the U.S. Pat. No. 5,398,647 to Rivera (1995). Also Bergeron (1991) proposed a valve with apertures disposed through its head in the U.S. Pat. No. 5,005,538. Most recently a different approach to increase the mass flow rate of gases is proposed by me in U.S. patent application Ser. No. 08/605857 entitled "colander valve and support members".

In spite of individual disadvantages of the above mentioned inventions of single poppet valve per cylinder, there are several main common disadvantages which are so serious that the above mentioned inventions are almost impractical in its present form for high speed IC engines. The main common disadvantages are mainly due to the large area of the head of single poppet valve per cylinder:

(1) For the flat head of a poppet valve, its weight is proportional to its area. Therefore, the weight of the head of single poppet valve per cylinder is much heavier than that of a conventional popper valve used in multi-valve IC engines with the same sized cylinder. The heavier valve head demands a heavier stem and, thus, significantly increases the load on the valve train. The heavier valve causes the "valve float" problem and other serious dynamic effects which Hit the speed of IC engines, such as larger hammering effects between the valve seat and the valve face. Also the closing and opening motion of the heavier valve is harder to control than a lighter valve. Bergeron's valve is heavier than a conventional poppet valve.

(2) The single poppet valve per cylinder absorbs more heat form combustion than conventional poppet valve used in multi-valve IC engines because that the single poppet valve per cylinder has larger head area contacting with burnt gases. The heat transformation from the head of the single poppet valve to the cylinder head is only through the face and the stem of the single poppet valve. Thus single poppet valve per cylinder operates under higher temperature. The hotter single poppet valve per cylinder transfers more heat to intake gases, which reduces the compression ratio, creates knock, reduces the mass flow rate of gases since the lower density of the hotter gases, and raises the fuel octane requirement. Also a valve with higher temperature has shorter life than that with lower temperature, and requires high-quality heat-resistant material which is expensive.

(3) Since the area of the head of single poppet valve per cylinder is large, the mechanical work required to open the single poppet valve at the beginning of the exhaust stroke against the cylinder end pressure of the power stroke is abnormal. This imposes heavy load on the valve train and an appreciable power loss.

(4) The large head area requires a strong strength against the combustion pressure, which makes single poppet valve per cylinder thick and, thus, heavy.

BRIEF SUMMARY OF THE INVENTION

It is continually needed to improve the volumetric efficiency and comprehensive performance of IC engines. A way to reach this goal is to employ single valve per cylinder with large head area. The present invention provides modified single valve per cylinder with support members and accordingly modified cylinder head to overcome above mentioned disadvantages of single popper valve per cylinder.

Accordingly the primary object of the present invention is to provide single colander valve per cylinder with at least one aperture on the head of the valve for enlarging the net intake valve open area and the areas of intake and exhaust ports further. There are two kinds apertures: face-up apertures and face-down aperture. Block valve(s) seals face-up aperture(s). Secondary valve(s) seals face-down aperture(s). In order to show the increases in net intake valve open area at the fully open position, as an example, single colander valve per cylinder with two face-up apertures and two face-down apertures is compared with two valves per cylinder and with single poppet valve per cylinder in table 1 to table 3. Some reasonable parameters and their values are used in table 1 to table 3. Note that a single colander valve per cylinder may have different combinations of face-up aperture(s) and face-down aperture(s) on its head and that each of the parameters in table 1 may take different values.

TABLE 1

COMPARISON BETWEEN DIFFERENT VALVES

| | Diameter of a valve head | Net intake valve open area | Net area of a valve head |
|---|---|---|---|
| two poppet valve per cylinder** | $R_1$ | $R_1L_1\pi$ | $(R_1/2)^2\pi$ |
| single poppet valve per cylinder** | $R_p$ | $R_pL_p\pi$ | $(R_p/2)^2\pi$ |
| single colander | $R_c$ | $(R_c/2)^2\pi -$ | $(R_c/2)^2\pi - \pi\Sigma(R_{ai}/2)^2 -$ |

TABLE 1-continued

COMPARISON BETWEEN DIFFERENT VALVES

| | Diameter of a valve head | Net intake valve open area | Net area of a valve head |
|---|---|---|---|
| valve per cylinder with 4 apertures* | | $\pi\Sigma(R_{ui}/2)^2$ | $\pi\Sigma(R_{dk}/2)^2$ |

**Net intake valve open area is the curtain area.

*$R_c$ is the diameter of the head of the colander valve. $R_{ui}$ and $R_{dk}$ are both the diameters of face-up and face-down apertures respectively, and the diameters of block valves and secondary valves respectively. The sum $\Sigma(R_{ui})^2$ is over i = 1, 2 for two face-up apertures and/or for two block valves. Block valves may or may not have same diameters. The sum $\Sigma(R_{dk})^2$ is over k = 1, 2 for two face-down apertures which may or may not have same diameters. Net intake valve open area is the difference between the total area of the head of the colander valve and the areas of heads of two block valves. The net area of a valve head is the difference between the total area of the head of the colander valve and the areas of four apertures.

Where D is the cylinder bore diameter. $L_1$ and $L_p$ are the valve lifts.

** Net intake valve open area is the curtain area.

* $R_c$ is the diameter of the head of the colander valve. $R_{ni}$ and $R_{dk}$ are both the diameters of face-up and face-down apertures respectively, and the diameters of block valves and secondary valves respectively. The sum $\Sigma(R_{ui})^2$ is over i=1, 2 for two face-up apertures and/or for two block valves. Block valves may or may not have same diameters. The sum $\Sigma(R_{dk})^2$ is over k=1, 2 for two face-down apertures which may or may not have same diameters. Net intake valve open area is the difference between the total area of the head of the colander valve and the areas of heads of two block valves. The net area of a valve head is the difference between the total area of the head of the colander valve and the areas of four apertures.

To show numerically how much intake valve open area increases approximately by using single colander valve with four apertures, taking typical numbers for $R_1$ and $L_1$, $R_1$=0.4450 D and $L_1$=0.2500 $R_1$, and taking reasonable values for $R_c$, $R_{dk}$, and $R_{ui}$, $R_c$=0.7016 D, $R_{d1}$=$R_{d2}$=0.3017 D, $R_{u1}$=$R_{u2}$=0.2369 D.

Also for comparison, taking $R_p$=0.6164 D and $L_p$=0.1541 D

The valve lift $L_p$ takes the smaller value of $L_p$=0.25 $R_p$ and $L_p$=(D - $R_p$)/2. With the above numbers, table 1 becomes:

TABLE 2

NUMERICAL COMPARISON BETWEEN DIFFERENT VALVES

| | Diameter of a valve head | Net intake valve open area | Net area of a valve head |
|---|---|---|---|
| two poppet valves per cylinder | 0.4450 D | 0.0495 $D^2\pi$ | 0.0495 $D^2\pi$ |
| single colander valve per cylinder with 4 apertures | 0.7016 D | 0.0950 $D^2\pi$ | 0.0495 $D^2\pi$ |
| single poppet valve per cylinder | 0.6164 D | 0.0950 $D^2\pi$ | 0.0950 $D^2\pi$ |

Table 3 below shows the ratio of the values in table 2 and that single colander valve per cylinder with four apertures significantly extends the net intake valve open area that the gases flow through.

TABLE 3

RATIO

| RATIO | Diameter of a valve head | Net intake valve open area | Net area of a valve head |
|---|---|---|---|
| $\frac{\text{single colander valve per cylinder*}}{\text{two valves per cylinder*}}$ = | 158% | 192% | 1 |
| $\frac{\text{single colander valve per cylinder*}}{\text{single poppet valve per cylinder*}}$ = | 114% | 1 | 52% |

*Diameter of a valve head, for the colander valve, is the diameter of the head of single colander valve per cylinder.

The other main objects and advantages are the following.

(a) to provide single colander valve which is fighter in weight than the intake valve of two poppet valves per cylinder and than single popper valve per cylinder, while providing larger net intake valve open area. As an example, the last columns of table 1 to table 3 also show the comparison of the weights of the heads of different valves since the weight of a flat valve head is approximately proportional to the area of the head. For the same net valve open area, the weight of single colander valve per cylinder is about 50% of that of single poppet valve per cylinder. Also for the same net intake valve open areas, the weight of single colander valve per cylinder is lighter than that of the intake valve of two poppet valves per cylinder. The opening and dosing motion of a lighter valve is easier to control at high speed, which permit an increase in engine speed and better performance.

(b) to provide support members including block valves and secondary valves for sealing the face-up and face-down apertures respectively without increasing the weight of the single colander valve train.

(c) to provide block valves which transfers heat to the cylinder head much effectively so that single colander valve per cylinder and support members are operated under lower temperature. The advantages of a lower temperature single colander valve per cylinder are the following:

(1) having a greater durability.

(2) transferring less heat to intake gases. Cooler intake gases allows a higher compression ratio than does hotter intake gases. The mass flow rate of gases is improved because of the higher density of cooler intake gases. The tendency to knock is reduced. The fuel octane requirement is lowered.

(3) being made by inexpensive material.

(4) decreasing the formation of polluting emission.

(d) to provide block valves to support single colander valve against the combustion pressure.

(e) to provide secondary valves to decrease the mechanical work required to open the single colander valve at the beginning of the exhaust stroke against the combustion end pressure on the power stroke by opening one or all of secondary valve(s) earlier than the colander valve.

Now it is practical to employ single colander valve per cylinder and support members including block valve(s) and secondary valve(s) in an IC engine to improve its comprehensive performance, because that single colander valve per cylinder and support members overcome the above mentioned disadvantages of single poppet valve per cylinder, while contains the advantages of both single valve per cylinder and colander valve.

The further objects and advantages are the following.

(f) to provide a cylinder head with single colander valve per cylinder with support members, which has the ability to complete the exhaust stroke and begin the intake stroke with the single colander valve in the fully open position to increase the volumetric efficiency.

(g) to provide single colander valve per cylinder and block valves for reciprocating spark ignition engines, which perfectly meet one of the main requirements in combustion chamber design that the exhaust valve should be as close as possible to the spark plug, by mounting a spark plug into one of block valves when the block valve is large enough. Now the spark plug is on the exhaust valve.

(h) to provide single colander valve per cylinder to increase the turbulence in a combustion chamber by the complex interaction between the gases flowing through aperture(s) and the face of the single colander valve. The high turbulence increases the rate of flame development and propagation and, thus, allows lean mixture to be burnt. As the air-fuel mixture is lean, there is a good fuel economy and a reduction in pollution emission, and the susceptibility to knock is reduced.

(i) to provide a cylinder head with single colander valve per cylinder which is so structured that both higher compression ratio and good gases flow are allowed.

(j) to provide secondary intake/exhaust means and one of these means includes a secondary intake valve and a secondary exhaust valve and prior-to-combustion chamber which is a cross-flow chamber: the secondary intake valve and the secondary exhaust valve are located on opposite sides, this design allows for straighter intake port and exhaust port and improved breathing.

Further objects and advantages of the present invention will become apparent from a consideration of the ensuing description and drawings.

BRIEF DESCRIPTION OF DRAWINGS

There is at least one aperture disposed on the head of the single colander valve per cylinder as shown in FIG. 1 and FIG. 2. As examples, the single colander valve per cylinder in the drawings FIG. 3, FIG. 6, and FIG. 7*a* have one face-up aperture and one face-down aperture. In the drawings closely related figures have the same numbers but different alphabetic suffixes. Also in general it is advantageous to round turns and corners in a cylinder head and on valves and seats. The aforementioned effects and advantages of the present invention will be appreciated from the following drawings.

PREFERRED EMBODIMENT OF THE INVENTION, AND RAMIFICATION

Reference is made specifically to the drawings wherein like numerals are used to designate like members throughout. A preferred embodiment of the present invention is illustrated in FIG. 1 to FIG. 6 and FIG. 8. FIG. 1 to FIG. 3 show different colander valves for preferred embodiment. FIG. 5*a* to FIG. 5*d* show different block valves for the preferred embodiment. A colander valve has at least one aperture disposed on its head. Colander valves in FIG. 3, FIG. 6, and FIG. 7*a*, as examples, have one face-up and one face-down apertures. FIG. 6 shows a single colander valve per cylinder which is in series with a secondary intake valve and a secondary exhaust valve that put it into communication alternately with the intake and exhaust ports. There are several joint means to joint block valves to a cylinder head. Each joint means requires different ends of stems. Therefore the ends of the stems of block valves are not shown in drawings.

Figure 1A:
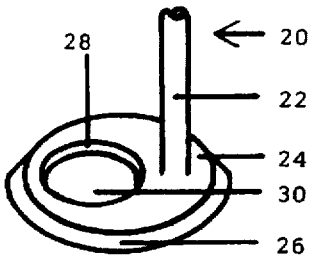
FIG. 1*a* shows a perspective view of a colander valve with a face-up aperture.
Figure 1B:
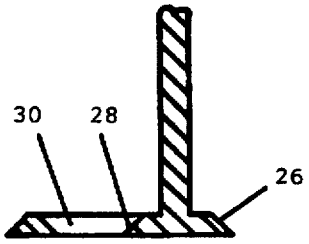
FIG. 1*b* shows a cross sectional view of the colander valve.

FIG. 1*a* and FIG. 1*b* show colander valve 20 with one face-up aperture 30. Colander valve 20 has stem 22, head 24 jointed to stem 22, face 26 disposed around the perimeter of head 24, and aperture face 28 disposed on face-up aperture 30. This kind of colander valve may have more than one face-up apertures disposed on the valve heads and may be used not only on IC engines which have single colander valve per cylinder but also on IC engines which have at least two valves per cylinder.

Figure 2A:
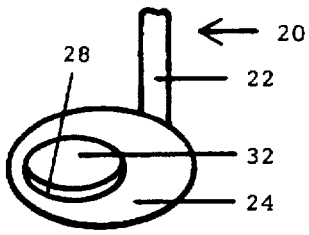
FIG. 2*a* shows a perspective view from bottom of a colander valve with a face-down aperture.
Figure 2B:
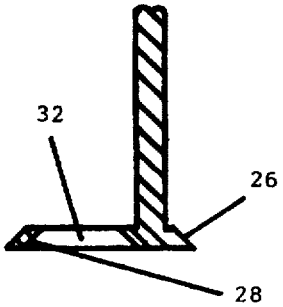
FIG. 2*b* shows a cross sectional view of the aperture.

FIG. 2*a* and FIG. 2*b* show colander valve 20 which has stem 22, head 24 jointed to stem 22, face 26, one face-down aperture 32 disposed on head 24, and aperture face 28 disposed on face-down aperture 32. This kind of colander valve may have more than one face-down apertures disposed on the valve heads and may be employed not only on IC engines with single colander valve per cylinder but also on IC engines with at least two valves per cylinder.

Figure 3A:
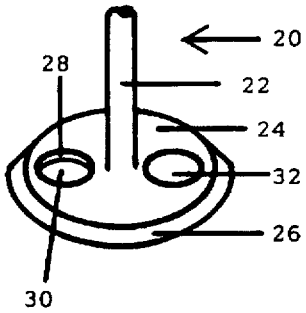
FIG. 3*a* shows a perspective view of a colander valve with a face-up aperture and a face-down aperture.
Figure 3B:
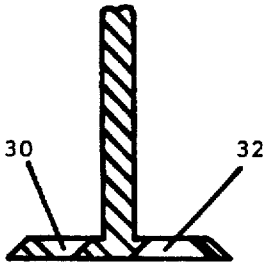
FIG. 3*b* shows a cross sectional view of the colander valve.

FIG. 3*a* and FIG. 3*b* show colander valve 20 with one face-up aperture 30 and one face-down aperture 32. Stem 22 is jointed to head 24 with face 26 disposed on it. This kind of colander valve may have more than one face-down apertures and/or more than one face-up apertures disposed on the valve heads and may be employed not only on IC engines with single colander valve per cylinder but also on IC engines with at least two valves per cylinder.

Figure 4:
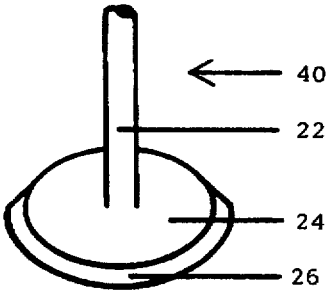
FIG. 4 shows a perspective view of a secondary valve.

FIG. 4 shows secondary valve 40 which is a conventional poppet valve and has stem 22, head 24 jointed to stem 22, and face 26. Head 24 is so sized that secondary valve 40 will seal and open face-down aperture 32 on colander valve 20. Secondary valve 40 and face-down aperture 32 are self-aligning.

Figure 5A:
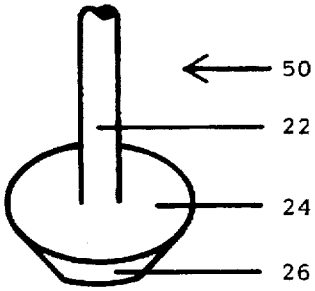
FIG. 5*a* shows a perspective view of a block valve.
Figure 5B:
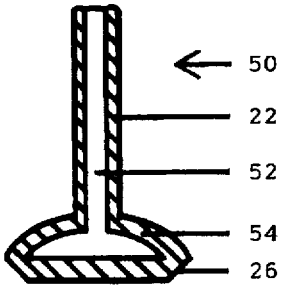
FIG. 5*b* shows a cross sectional view of a block valve with an aerodynamic head and hollow.
Figure 5C:
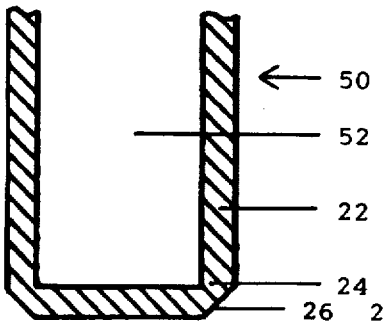
FIG. 5*c* shows a cross sectional view of a block valve with a hollow.
Figure 5D:
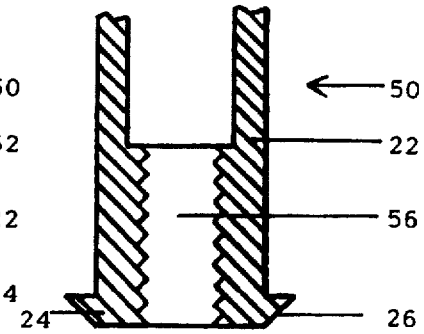
FIG. 5*d* shows a cross sectional view of a block valve with a partially tappet hollow for housing either a spark plug or a fuel injector.

FIG. 5*a* to FIG. 5*d* show different block valves for sealing face-up aperture(s). Block valve 50 of FIG. 5*a* has stem 22 jointed to flat head 24. Face 26 is disposed on head 24. FIG. 5*b* shows block valve 50 with aerodynamically shaped head 54 and hollow 52 disposed in block valve 50. When block valve 50 jointed rigidly to a cylinder head, hollow 52 will connect with coolant passage in the cylinder head so that coolant will circulates through hollow 52. FIG. 5*c* shows that both stem 22 and head 24 of block valve 50 have approximately same diameters. Hollow 52 disposed in block valve 50 is for coolant flowing into it to cool block valve 50. Block valve 50 of FIG. 5*d* has partially tappet hollow 56 disposed in stem 22 and through head 24 for housing a spark plug or a fuel injector.

All of head 24 and head 54 and face 26 of different block valve 50 of FIG. 5*a* to FIG. 5*d* are sized and angled so that block valve 50 will seal face-up aperture 30 on colander valve 20. Block valve 50 and face-up aperture 30 are self-aligning.

Figure 6A:
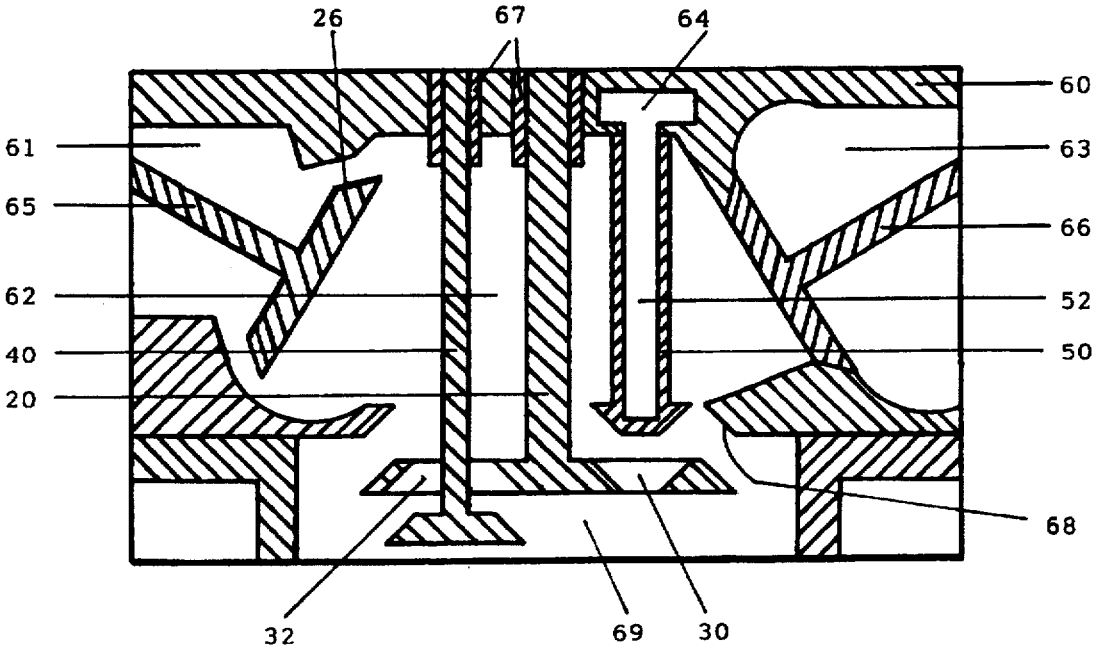
FIG. 6*a* shows a side elevational view of an assembly of single colander valve per cylinder, block valve, secondary valve, secondary intake valve, and secondary exhaust valve, at an open position of both the colander valve and secondary intake valve.
Figure 6B:
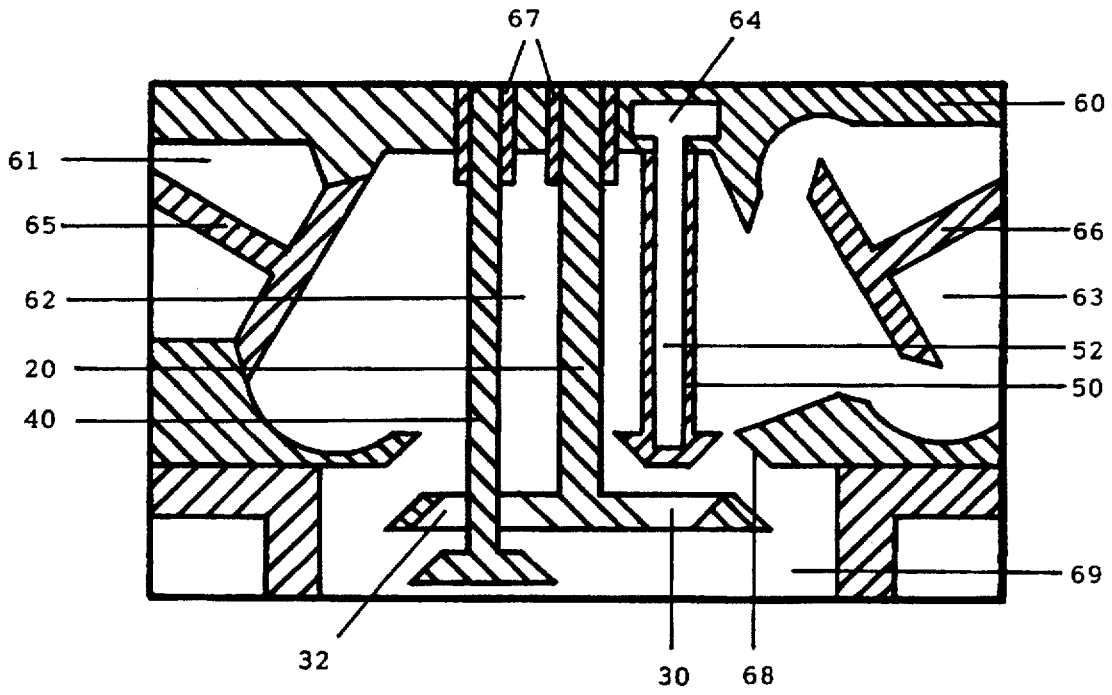
FIG. 6*b* shows a side elevational view of an assembly of a single colander valve per cylinder, block valve, secondary valve, secondary intake valve, and secondary exhaust valves at an open position of both the colander valve and secondary exhaust valve.
Figure 6C:
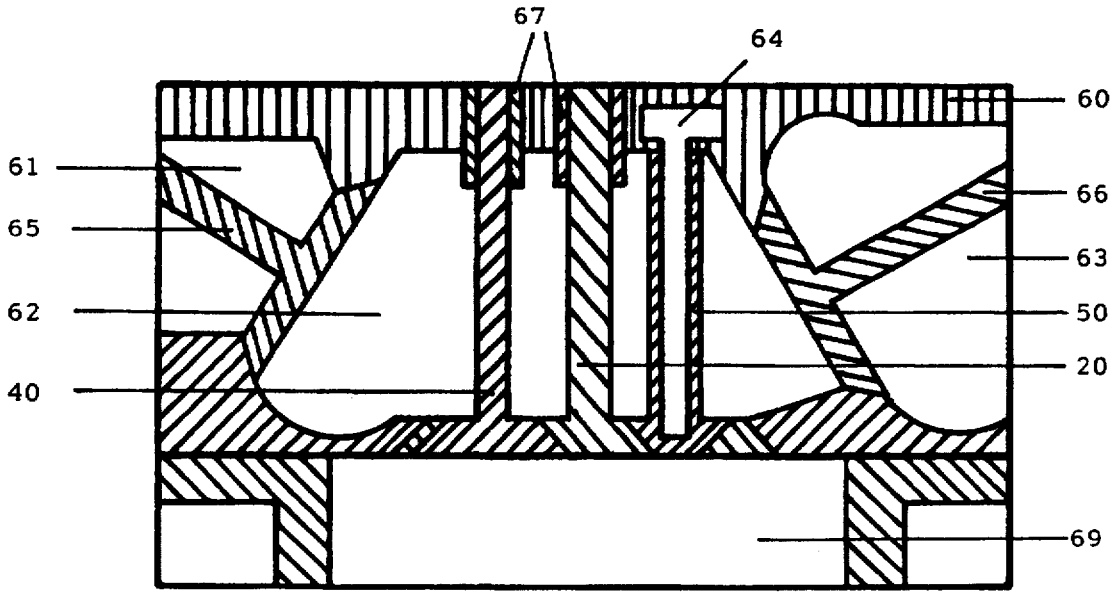
FIG. 6*c* shows a side elevational view of an assembly of single colander valve, block valve, secondary valve, secondary intake valve, and secondary exhaust valves at a closure position of all valves.

FIG. 6*a* to FIG. 6*c* show an assembly of cylinder head 60, intake port 61, exhaust port 63, colander valve 20, secondary valve 40, block valve 50, prior-to-combustion chamber 62, secondary intake valve 65, and secondary exhaust valve 66. There are timing means (not shown) to control open and close motions of secondary intake valve 65, secondary exhaust valve 66, secondary valve 40, and colander valve 20, respectively. Since there is no high combustion pressure acting on secondary intake and exhaust valves, secondary intake and exhaust valves may be made less strength and light weight and, therefore, secondary intake and exhaust valves open and close quickly.

FIG. 6*a* shows the positions of valves at the intake stroke: colander valve 20, secondary intake valve 65, face-down aperture 32, and face-up aperture 30 are open and, thus, fuel-air mixture or air flow into combustion chamber 69 via prior-to-combustion chamber 62. Secondary valve 40 may be in either open position or closure position after colander valve 20 opens. At the fully open position of colander valve 20, secondary valve 40 closes face-down aperture 32 (not shown). Secondary intake valve 65 starts to open before the intake stroke begins. When the intake stroke begins, colander valve 20 is already in fully open position and lets fuel-air mixture or air into combustion chamber 69. Secondary exhaust valve 66 is at closure position. Coolant flows through coolant passage 64 into hollow 52 to cool block valve 50.

FIG. 6*b* shows the positions of valves at the exhaust stroke: colander valve 20, secondary valve 40, face-up aperture 30, and secondary exhaust valve 66 are at open positions, and secondary intake valve 65 is at closure position. Secondary exhaust valve 66 starts to open before the exhaust stroke begins. When the exhaust stroke begins, secondary valve 40 starts to open before colander valve 20 starts for releasing combustion end gas pressure in the combustion chamber without requiring large amount of work, because of smaller head area of secondary valve 40. Then colander valve 20 starts to open and, simultaneously, face-up aperture 30 starts to open, because that block valve 50 is rigidly jointed to cylinder head 60. After colander valve 20 starts to open, secondary valve 40 may either close face-down aperture 32 and move with colander valve 20 or still keep face-down aperture 32 open depending on desires. At the fully open position of colander valve 20, secondary valve 40 closes face-down aperture 32 (not shown). The exhaust gases will flow out through prior-to-combustion chamber 62. At the end of the exhaust stroke, secondary intake valve 65 starts to open before secondary exhaust valve 66 being completely closed for blowing burnt gases out. Prior-to-combustion chamber 62 is a cross-flow chamber, that is, secondary intake valve 65 and secondary exhaust valve 66 are located on opposite sides, this design allows for straighter intake port 61 and exhaust port 63 and improved breathing.

FIG. 6*c* shows the compression stroke and power stroke in which colander valve 20, secondary intake valve 65 and apertures are closed. Secondary exhaust valve 66 may be in either closure position (as shown) or open positions (not shown). Block valve 50 will support colander valve 20 against combustion pressure and transfers heat from colander valve 20 to cylinder head 60 effectively through not only its stem 22 but also coolant in hollow 52 which jointed to coolant passage 64 in cylinder head 60. Also some of heat will transfer to cylinder head 60 through both stem 22 of secondary valve 40 and face 26 of colander valve 20.

Figure 7A:
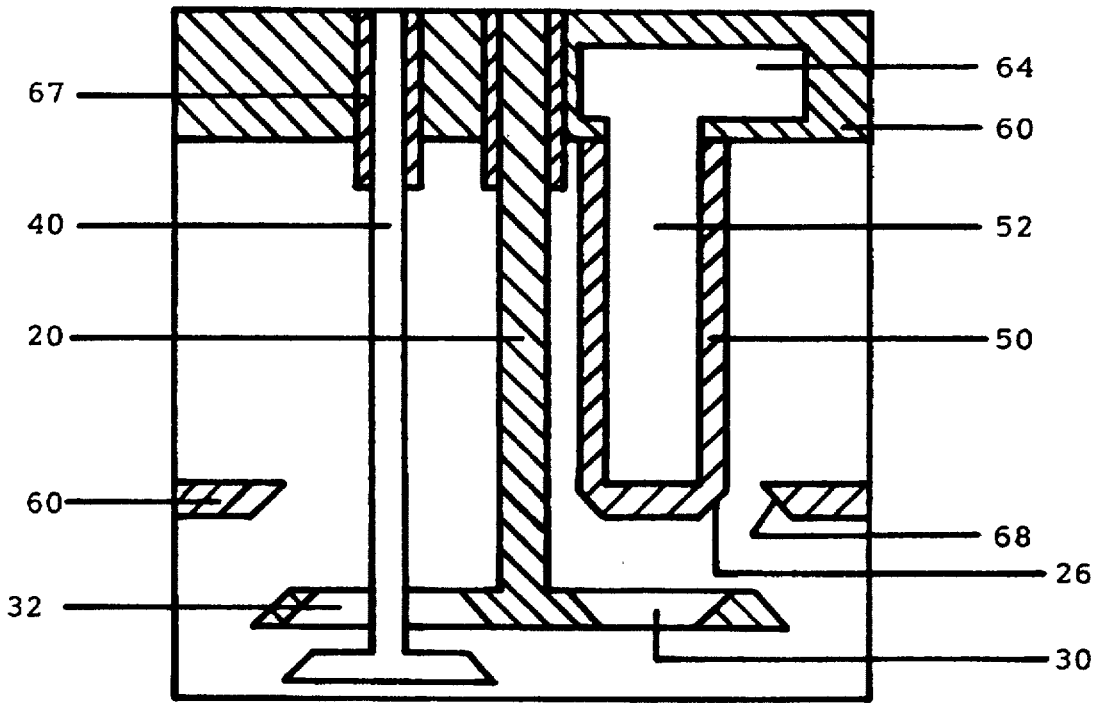
FIG. 7*a* shows a side elevational view of an assembly of single colander valve per cylinder, block valve, and secondary valve at an open position of the colander valve.

FIG. 7*a* shows colander valve 20 with one face-up aperture 30 and one face-down aperture 32, secondary valve 40, and block valve 50. For a large colander valve, there may be more than one face-up apertures and/or more than one face-down apertures on colander valve 20. This kind of colander valve 20 may be used not only in IC engines with single colander valve per cylinder as shown in FIG. 6, but also in IC engines with two or more valves per cylinder. Block valve 50 jointed rigidly to cylinder head 60 will seal and open face-up aperture 30 and will transfer heat to cylinder head 60 very effectively through coolant in hollow 52 jointed to coolant passage 64 in cylinder head 60, and will support colander valve 20 in the power stroke. Secondary valve 40 moves up and down freely in guide 67 without leakage of oil to seal and open face-down aperture 32. The weight of colander valve 20 is reduced by having face-up and face-down apertures.

Figure 7B:
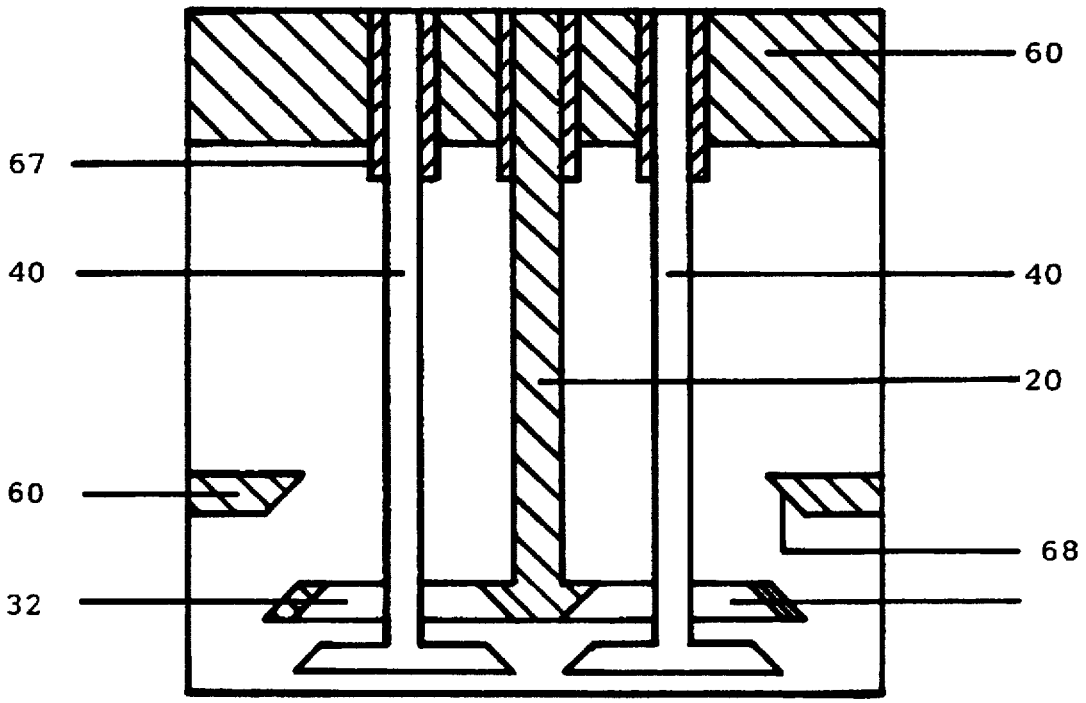
FIG. 7*b* shows a side elevational view of an assembly of single colander valve and two secondary valves at an open position of the colander valve.

FIG. 7*b* shows a side elevational view of colander valve 20 with two face-down aperture 32 at open position. Two secondary valve 40 are controlled by timing means (not show) to seal and open two face-down aperture 32 respectively. Instead of a conventional poppet valve, colander valve 20 with at least one face-down aperture may be used in IC engines which have two or more valves per cylinder.

Figure 8:
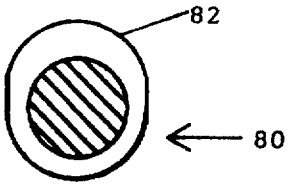
FIG. 8 shows a cross sectional view of a cam.

FIG. 8 shows cam 80 with oyster-shaped lobe 82 to be able to complete the exhaust stroke and begin the intake stroke with single colander valve 20 per cylinder in the fully open position.

Although the description above contains many specificities, these should not be construed as limiting the scope of the present invention but as merely providing illustrations of some of the presently preferred embodiments of the present invention. For example, the secondary intake valve and secondary exhaust valve may be electromagnetic valves; secondary intake and exhaust valves may be colander valves; the secondary intake/exhaust valve may be a rotary valve or a mechanical disc valve for alternately controlling the fuel-air mixture or air flowing into the prior-to-combustion chamber and the exhaust gases flowing out of the prior-to-combustion chamber; the face-up aperture (s), block valve(s), face-down aperture(s), and secondary valve(s) may have different shapes, as long as the shapes of block valve(s) and secondary valve(s) fit face-up aperture(s) and face-down aperture(s) respectively, etc.

Thus the scope of the present invention should be determined by the appended claims and their legal equivalents, rather than by the example given.

I claim:

1. A cylinder head with a single colander valve per cylinder having an intake port and an exhaust port for internal combustion engines (IC engine) and the like and said IC engines defining a combustion chamber, comprising in combination:

(a) the single colander valve per cylinder alternately controlling the fuel-air mixture or air flowing into said combustion chamber and the exhaust gases flowing out of said combustion chamber and wherein said colander valve including a stem, a head, and a face disposed around the perimeter of said head and wherein said head including at least one aperture disposed through it;

(b) primary timing means for timing said colander valve;

(c) sealing means for accordingly sealing and opening said aperture(s) without adding weight to the valve train of said colander valve;

(d) a prior-to-combustion chamber alternately communicating with said combustion chamber, said intake port, and said exhaust port and wherein said prior-to-combustion chamber is positioned between said combustion chamber, said intake port, and said exhaust port; and (e) secondary intake/exhaust means for alternately controlling fuel-air mixture or air flowing into said prior-to-combustion chamber and exhaust gases flowing out said prior-to-combustion chamber.

2. The cylinder head with a single colander valve per cylinder of claim 1 wherein said secondary intake/exhaust means comprising a secondary intake/exhaust valve and secondary timing means and whereby said secondary intake/exhaust valve alternately controlling fuel-air mixture or air flowing from said intake port into said prior-to-combustion chamber and exhaust gases flowing out of said prior-to-combustion chamber to said exhaust port and whereby said secondary timing means timing said secondary intake/exhaust valve in cooperation with the timing of said single colander valve.

3. The cylinder head with a single colander valve per cylinder of claim 1 wherein said secondary intake/exhaust means comprising a secondary intake valve closing and opening said intake port, a secondary exhaust valve closing and opening said exhaust port, and secondary timing means for timing both said secondary intake valve and said secondary exhaust valve in cooperation with the timing of said single colander valve respectively.

4. The cylinder head with a single colander valve per cylinder of claim 3 wherein both said secondary intake valve and said secondary exhaust valve being poppet valves.

5. The cylinder head with a single colander valve per cylinder of claim 4 wherein said secondary intake poppet valve opening into said prior-to-combustion chamber and wherein said secondary exhaust poppet valve opening into said exhaust port.

6. The cylinder head with a single colander valve per cylinder of claim 1 wherein said primary timing means comprising an oyster-shaped cam completing the exhaust stroke and beginning the intake stroke with said single colander valve per cylinder in the fully open position.

7. The cylinder head with a single colander valve per cylinder of claim 1 wherein said aperture(s) being face-up aperture(s) and wherein said sealing means accordingly comprising block valve(s) each sized to fit sealably within each of said face-up aperture(s) respectively and joint means for rigidly jointing said block valve(s) to said cylinder head.

8. The cylinder head with a single colander valve per cylinder of claim 7 wherein said block valve(s) being one or a combination of the following: (a) block valve(s) comprising a stem and a flat head with a face disposed on its perimeter, (b) block valve(s) comprising a stem, a head, and a partially tapped hollow disposed inside said stem and through the center of said head and whereby said hollow housing a spark plug or a fuel injector, (c) block valve(s) comprising a stem, a flat head, and a hollow disposed inside both said stem and said head, (d) block valve(s) comprising a stem, a head which being aerodynamically shaped, and a hollow disposed inside both said stem and said head, and (e) block valve(s) comprising a head, a stem having similar diameter as that of said head, and a hollow disposed inside both said head and said stem.

9. The cylinder head with a single colander valve per cylinder of claim 1 wherein said aperture(s) being face-down aperture(s) and wherein said sealing means accordingly each sized to fit sealably within each of said face-down aperture(s) respectively, timing means for timing said secondary valve(s) in cooperation with the timing of said single colander valve, and joint means for mounting slidably said secondary valve(s) to said cylinder head and whereby said secondary valve(s) moving up and down freely to seal and open said face-down aperture(s) accordingly.

10. The cylinder head with a single colander valve per cylinder of claim 9 wherein said secondary valves being poppet valve(s).

11. The cylinder head with a single colander valve per cylinder of claim 1 wherein said apertures being a combination of at least one face-up aperture and at least one face-down aperture and wherein said sealing means accordingly comprising a combination of at least one block valve each sized to fit sealably within each of said face-up and face-down aperture(s) respectively, timing means for timing said secondary valve(s) in cooperation with the timing of said single colander valve, joint means for rigidly jointing said block valve(s) to said cylinder head, and joint means for slidably mounting said secondary valve(s) to said cylinder head and whereby said secondary valve(s) moving up and down freely to seal and open said face-down aperture(s) accordingly.

12. The cylinder head with a single colander valve per cylinder of claim 11 wherein said block valve(s) being one or a combination of the following: (a) block valve(s) comprising a stem and a flat head with a face disposed on its perimeter, (b) block valve(s) comprising a stem, a head, and a partially tapped hollow disposed inside said stem and through the center of said head and whereby said hollow housing a spark plug or a fuel injector, (c) block valve(s) comprising a stem, a flat head, and a hollow disposed inside both said stem and said head, (d) block valve(s) comprising a stem, a head which being aerodynamically shaped, and a hollow disposed inside both said stem and said head, and (e) block valve(s) comprising a head, a stem which has similar diameter as that of said head, and a hollow disposed inside both said head and said stem.

13. The cylinder head with a single colander valve per cylinder of claim 1, further including alignment means for aligning said sealing means with said aperture(s) on said single colander valve head accordingly.

14. A colander valve and support members for an internal combustion engine (IC engine) and the like comprising in combination:

(a) a colander valve alternately controlling the fuel-air mixture or air flowing into the combustion chamber of said IC engine and the exhaust gases flowing out said combustion chamber and wherein said colander valve having a stem, a head, and a face disposed around the perimeter of said head and wherein said head having at least one face-down aperture disposed there through and wherein said aperture(s) having valve seat(s);

(b) at least one secondary valve sized to fit sealably within said face-down aperture(s) respectively;

(c) jointing means for supporting said secondary valve(s) connecting said secondary valve(s) to the cylinder head of said IC engine and allowing said secondary valve(s) moving up and down freely to seal and open said face-down aperture(s) respectively; and (d) timing means for timing said secondary valve(s) in cooperation with the timing of said colander valve.

15. The colander valve and support members for an internal combustion engine (IC engine) and the like of claim 14, further including:

(a) at least one face-up aperture disposed through said head of said colander valve;

(b) at least one block valve sized to fit sealably within said face-up aperture(s) respectively.

16. The colander valve and support members for an internal combustion engine (IC engine) and the like of claim 15, further including jointing means for supporting said block valve(s) connecting rigidly said block valve(s) to the cylinder head of said IC engine.

17. The colander valve and support members for an IC engine and the like of claim 15 wherein said block valve(s) being one or a combination of the following: (a) block valve(s) comprising a stem and a flat head with a face disposed around its perimeter; (b) block valve(s) comprising a stem, a head, and a partially tapped hollow disposed inside said stem and through the center of said head and whereby said hollow housing a spark plug or a fuel injector; (c) block valve(s) comprising a stem, a flat head, and a hollow disposed inside both said stem and said head; (d) block valve(s) comprising a stem, a head which being aerodynamically shaped, and a hollow disposed inside both said stem and said head; and (e) block valve(s) comprising a head, a stem having similar diameter as that of said head, and a hollow disposed inside both said head and said stem;

Whereby the comprehensive performance of an IC engine and the like is greatly improved by using colander valve(s) either as the single colander valve per cylinder or as at least one of valves used in each cylinder of the IC engine and the like.

* * * * *